US006089732A

United States Patent [19]

Wright et al.

[11] Patent Number: 6,089,732

[45] **Date of Patent: *Jul. 18, 2000**

[54] UNIVERSAL TYPE I.C. /NON-TYPE I.C. RECESSED DOWNLIGHT HOUSING CAN ASSEMBLY AND METHOD FOR MARKING THE CAN ASSEMBLY

[75] Inventors: Philip Dean Wright, Waveland; Mark E. Jennings; Bryan Scott Steele, both of Crawfordsville, all of Ind.

[73] Assignee: NSI Enterprises, Inc., Atlanta, Ga.

[ * ] Notice: This patent is subject to a terminal disclaimer.

[21] Appl. No.: 09/191,447

[22] Filed: Nov. 12, 1998

Related U.S. Application Data

[63] Continuation-in-part of application No. 08/686,669, Jul. 26, 1996, Pat. No. 5,836,678.

[51] Int. Cl.[7] ..... F21S 1/06

[52] U.S. Cl. ..... 362/364; 362/294; 362/276; 362/802; 362/373; 362/147; 362/365

[58] Field of Search ..... 362/147, 276, 362/294, 365, 373, 802, 364

[56] References Cited

U.S. PATENT DOCUMENTS 4,685,037 8/1987 Akiyama ..... 362/276

*Primary Examiner*—Sandra O'Shea
*Assistant Examiner*—Ali Alavi
*Attorney, Agent, or Firm*—Kenneth E. Darnell

[57] ABSTRACT

A universal housing can assembly used as a component of a recessed downlight fixture and which can be utilized in both insulation contact (I.C.) and non-insulation contact (non-I.C.) applications. The preferred housing can is deep drawn of aluminum or other suitable materials and is configured to operate at or below thermal standards for I.C. applications and also for non-I.C. applications. The housing can assemblies formed according to the invention utilize thermal protective devices positioned within the assemblies to shut the fixture off or "cycle" the fixture in the event that predetermined thermal conditions are exceeded in either an I.C. or a non-I.C. application. According to the invention, a single can assembly can be used as and marked as both I.C. and non-I.C. housing cans

45 Claims, 9 Drawing Sheets

TYPICAL I.C. FIXTURE

TYPICAL NON-I.C. FIXTURE

UNIVERSAL TYPE I.C. /NON-TYPE I.C. RECESSED DOWNLIGHT HOUSING CAN ASSEMBLY AND METHOD FOR MARKING THE CAN ASSEMBLY

CROSS-REFERENCE TO RELATED APPLICATION

This application is a continuation-in-part of U.S. patent application Ser. No. 08/686,669, filed Jul. 26, 1996 now U.S. Pat. No. 5,836,678, by the same inventors, this application having the same assignee.

BACKGROUND OF THE INVENTION

1. Field of the Invention

The invention relates generally to recessed downlight fixtures and particularly to housing can assemblies used in such fixtures and which can be used in both insulation contact (I.C.) and non-insulated contact (non-I.C.) applications.

2. Description of the Prior Art

Lighting fixtures mounted in ceilings and particularly recessed downlighting fixtures are subject to stringent UL and CSA requirements due to potential hazards brought about by heat generated by lamping employed in such fixtures. A fixture is listed as I.C. to designate that the fixture can contact insulation. Typically, I.C. listed fixtures are buried in insulation and must operate with surface temperatures not to exceed 90° C. when properly lamped and which also must shut off or cycle on and off rapidly if fixture surface temperatures exceed 90° C. A fixture is listed as non-I.C. in the event that the fixture is not intended to contact insulation. In this situation, insulation must be kept at a minimum of 3" from the fixture. Non-I.C. fixtures must maintain fixture surface temperatures not to exceed 150° C. when properly lamped and must shut off or cycle if the fixture surface temperatures exceed 150° or are improperly contacted by insulation. These code requirements have previously caused manufacturers to produce and distributors to stock two different types of housings or cans, that is, the structure which houses the lamping of the fixture and which is that part of the fixture susceptible to highest surface temperatures. An I.C. housing of the prior art, for example, is severely restricted as to wattage of the lamping, it being necessary with many I.C. housings to position lamping below a ceiling opening above which opening the fixture is mounted. Non-I.C. housings of the prior art could be used with lamping of greater wattage and were structurally different from I.C. housings so that no one housing could be used in both I.C. and non-I.C. situations. The necessity to manufacture and stock two different housings increased costs and resulted in bothersome manufacturing scheduling and inventory problems.

The art has therefore felt a continuing need for a lighting fixture which can be recessed in a ceiling and which can be rated for both I.C. and non-I.C. situations. In particular, the art feels the need for a universal housing or can which can be used in both I.C. and non-I.C. situations. Realization of these needs as potentiated by the present universal can dramatically simplifies the manufacture and inventory maintenance of lamp housings particularly used in recessed downlighting applications.

SUMMARY OF THE INVENTION

The invention provides lamp housings forming a portion of recessed downlight fixtures and which are usable in both I.C. and non-I.C. applications with appropriate lamping and finishing trim. In particular embodiments, the housings of the invention are deep drawn, one-piece structures preferably formed of aluminum or steel without rivets or seams and which are light in weight, free of rust and lacking sharp edges and burrs. The universal housings of the invention meet stringent code requirements for both I.C. and non-I.C. applications as specified by UL standards and CSA certifications, the housings therefore being usable with a lighting fixture installed as either an I.C. installation or as a non-I.C. installation when properly lamped. Finishing trim designated either I.C. or non-I.C. is used as appropriate, I.C. rated trims being usable in non-I.C. applications with the same wattage. Trims utilized with the universal housings of the invention can be full reflector trims with lamp sockets so used preferably having fixed socket positions. The interface of the trim and socket with a universal housing provides proper and consistent photometric and thermal performance.

In an I.C. application, the surface temperature of any portion of the lighting fixture must not exceed 90° C. due to the fact that the fixture is typically buried in insulation in an I.C. application. Practically speaking, only the lamp housing and components inside of the housing approach this maximum temperature. The lamp housing must therefore be realized structurally in a form capable of eliminating or minimizing hot spots which can occur due to the presence of rivets, seams or sharp edges. Further, the housing must be formed of a material which will function appropriately in a thermal sense and which will not rust regardless of the service life of the fixture. Still further, the lamp housing must be shaped to provide maximum thermal performance. When properly lamped with lamping of an appropriate wattage, the lamp housing must allow for dissipation of sufficient heat by virtue of its surface area, interior volume, material of formation, etc., to prevent surface temperature at any location of the housing from exceeding 90° C.

The lamp housing forms a portion of a housing assembly which includes a thermal protector mounting on wall surfaces of the housing preferably at a location internally of the housing falling within a given range of locations defmed by a given area or areas of the wall surfaces. The thermal protector acts to shut off power to the lamp or to cycle the lamp in the event housing surface temperatures exceed 90° C. Trim designated I.C. and preferably taking the form of a full reflector completes the I.C. installation. A lamp wattage of 75W, such as is the wattage of a 75W R30 or BR30 lamp, is conveniently chosen as the lamp wattage utilized with the particular embodiments of the universal lamp housings. Recessed lighting fixtures configured with the universal lamp housing of the invention can contact and even be buried in the insulation.

The same universal lamp housings described above for use in I.C. applications can also be used and rated for non-I.C. installations. In non-I.C. installations, insulation cannot be placed closer than three inches to any portion of a fixture. The surface temperature of the lamp housing can therefore be equal to or less than 150° C., thereby allowing use of a lamp such as a 150W R40 or BR40 lamp. A full reflective trim rated for non-I.C. applications coupled with a socket maintained in a fixed position completes the non-I.C. installation. As with the I.C. installation, a thermal protector is employed to shut off or cycle the lamp in the event of the presence of temperatures exceeding a predetermined temperature, in this case usually taken to be 150° C.

The I.C./non-I.C. fixtures of the invention can employ pan structure of varying types including painted metal planar platforms. Pans utilizable as the support structure can be formed of thermoplastic material, wire, etc., as will be described hereinafter. Pans useful according to the invention typically mount J-box structures of varying design and formed of various materials. The fixtures of the invention can be configured to fit into various joist constructions and can accommodate ceilings of varying thickness by the provision of ceiling adjustment slots formed longitudinally of the housings.

The I.C./non-I.C. fixtures of the invention are further marked according to the invention with indicia enabling an installer to select appropriate trim and lamp wattage for use with the universal lamp housings of the invention.

Accordingly, it is an object of the invention to provide a recessed downlight fixture and particularly a lamp housing configured for use in both I.C. and non-I.C. installations.

It is another object of the invention to provide a universal lamp housing capable of conforming to ratings for both I.C. and non-I.C. installations.

It is a further object of the invention to provide marking for a universal lamp housing indicating the utility of the housing for I.C. and non-I.C. installations.

Further objects and advantages of the invention will become more readily apparent in light of the following detailed description of the preferred embodiments.

DESCRIPTION OF THE PREFERRED EMBODIMENTS

Figure 1:
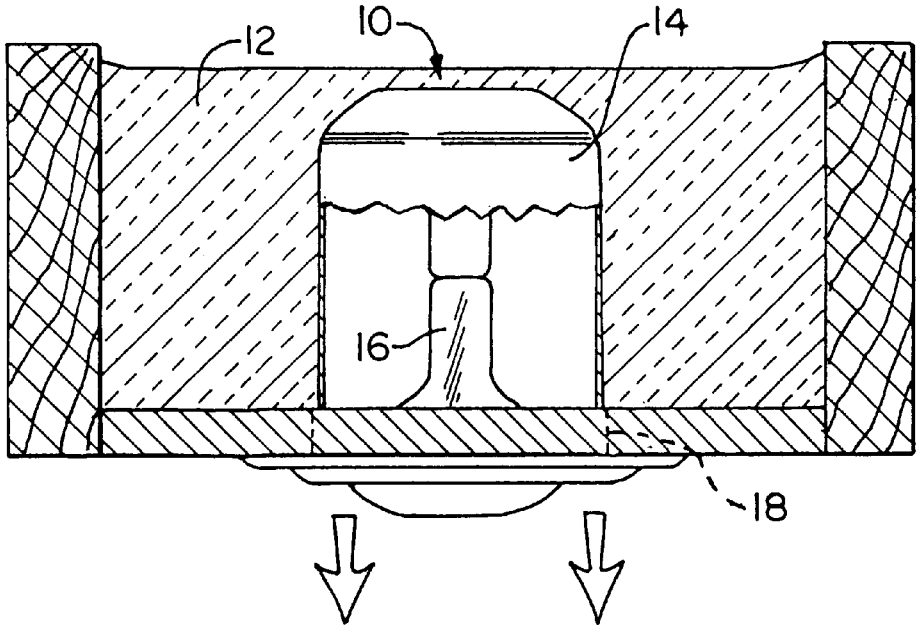
FIG. 1 PRIOR ART
FIG. 1 is a side elevational view in partial section of a prior art I.C. recessed downlight fixture illustrating an I.C. installation shown in a diagrammatical format.
Figure 2:
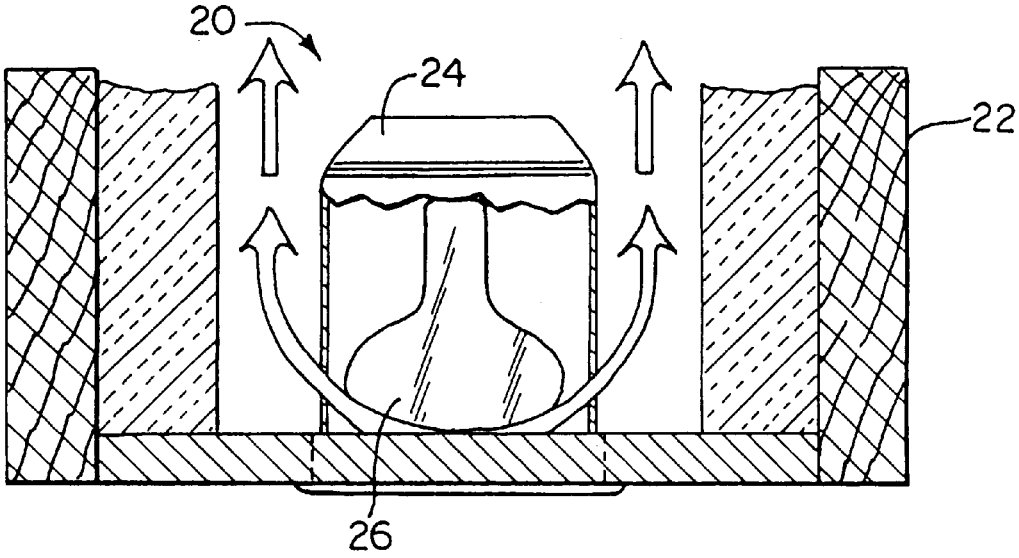
FIG. 2 PRIOR ART
FIG. 2 is a side elevational view in partial section of a prior art non-I.C. recessed downlight fixture illustrating a non-I.C. installation shown in a diagrammatical format.

Referring now to the drawings and particularly to FIGS. 1 and 2, a prior art recessed lighting fixture is seen at 10 to be installed in an I.C. application, that is, the fixture 10 contacts and actually is buried in insulation 12 over at least upper portions of the fixture. In order for the fixture 10 to be installable in the I.C. application shown in FIG. 1, it is necessary that the fixture be UL listed or CSA certified as I.C. rated. An I.C. rating specifies that the fixture 10 must operate at surface temperatures not to exceed 90° C. since the fixture directly contacts insulation. Since lamp housing 14 is the exterior portion of the fixture 10 which will experience the greatest surface temperature due to containment of heat generating lamp 16 within the interior of said housing 14, the I.C. rating effectively relates to the lamp housing 14. In prior art I.C. installations such as the typical installation seen in FIG. 1, this thermal standard is met by restricting the wattage of the lamp 16 and by positioning lower portions of the lamp 16 below ceiling opening 18 surmounted by the fixture 10. The appearance of the fixture 10 when so arranged is less than pleasant due to the visibility of the "bare bulb". Glare produced by the prior art arrangement of FIG. 1 also limits the acceptability of this prior art arrangement.

A non-I.C. rated prior art recessed lighting fixture is seen at 20 in FIG. 2 to be installed in an application whereby insulation 22 is maintained at a distance of at least three inches from all sides of the fixture, a requirement for UL rating of the fixture 20 as non-I.C. Accordingly, a non-I.C. fixture cannot contact insulation and must further operate at surface temperatures which cannot exceed 150° C. In effect, the surface temperature of lamp housing 24 must not exceed 150° C. since the lamp housing 24 is the only external portion of the fixture 20 which would experience such temperatures due to containment of lamp 26 within the confines of the housing 24. Requirements for rating as non-I.C. are typically met in the prior art in a manner satisfactory to fixture appearance and function. As an example, higher wattage lamps located in fully recessed positions (at least for certain wattage lamps) within the lamp housing 24 are permitted. However, the prior art installation as seen in FIG. 2 has substantial deficiencies with the primary deficiency being the creation of a "chimney effect" which acts to draw conditioned air out of the living space beneath the fixture 20 and into the attic or space within which the fixture 20 is mounted. A significant energy loss results.

The prior art fixtures 10 and 20 shown respectively in FIGS. 1 and 2 are provided in the prior art with respective lamp housings 14 and 24 which are respectively rated I.C. and non-I.C. In other words, the lamp housing 14 is rated I.C. and cannot be used in the non-I.C. fixture 20 as a replacement for the non-I.C. rated lamp housing 24. Similarly, the lamp housing 24 is rated non-I.C. and cannot be used in the I.C. fixture 10 as a replacement for the I.C. rated lamp housing 14. A manufacturer must therefore produce two separate lamp housings, one for I.C. rating and a separate one for non-I.C. rating. These two different lamp housings have structural differences and handle heat loading differently. A manufacturer must divine the future and determine the number of each of the lamp housings which must be produced. Similarly, a distributor must stock both I.C.-rated and non-I.C.-rated lamp housings and can only guess whether market conditions at any given time will cause a shortage of one housing or the other given even the most insightful sales projections.

The lamp housings and light fixtures provided according to the invention eliminate the need for the manufacture and stocking of two separately rated lamp housings by the provision of a single lamp housing structure and assembly which is rated I.C. and non-I.C. by virtue of meeting the separate specifications for these ratings in a single lamp housing and lamp housing assembly.

Figure 3:
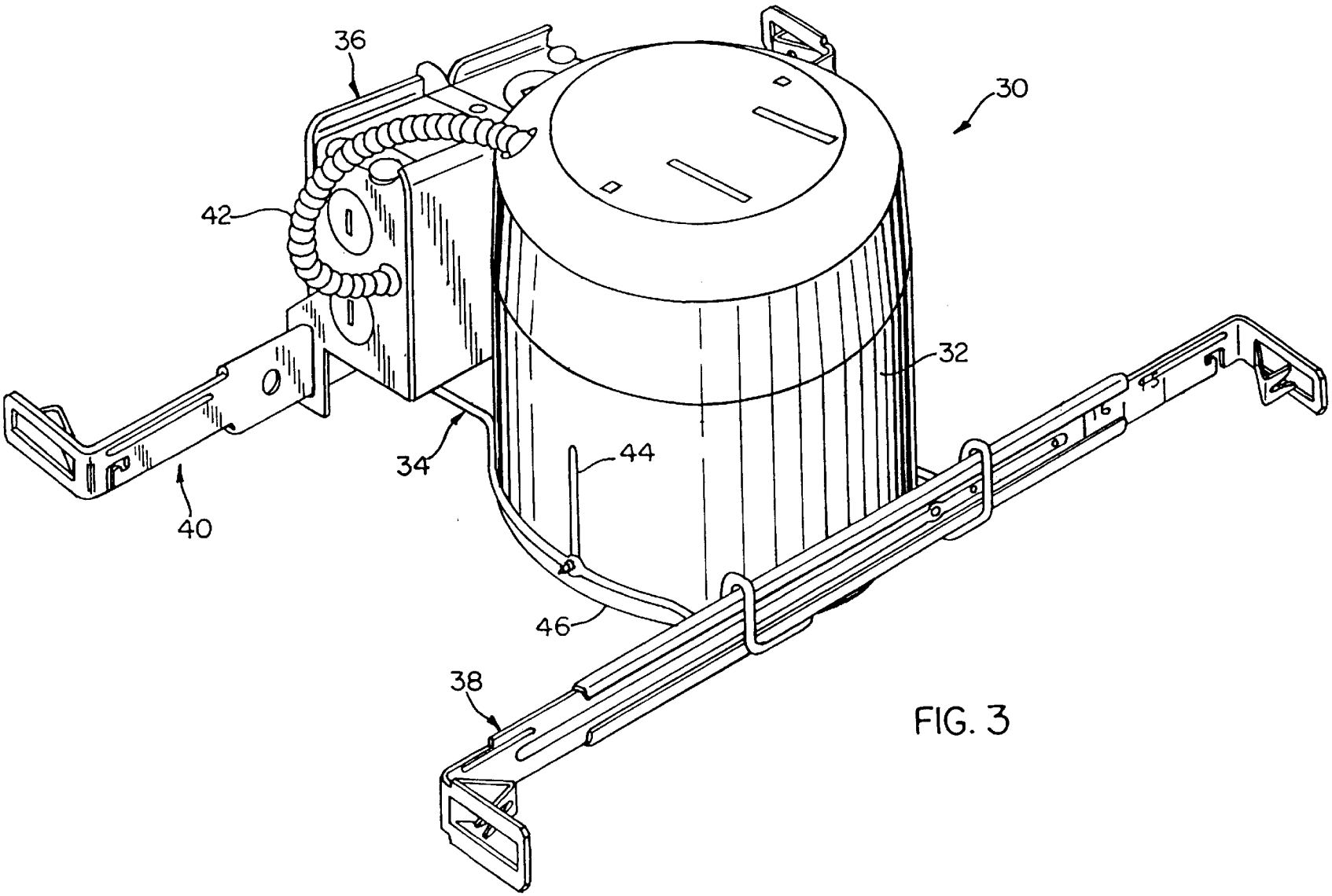
FIG. 3 is a perspective view of an I.C./non-I.C. downlight fixture including a universal I.C./non-I.C. lamp housing configured according to the invention.
Figure 4:
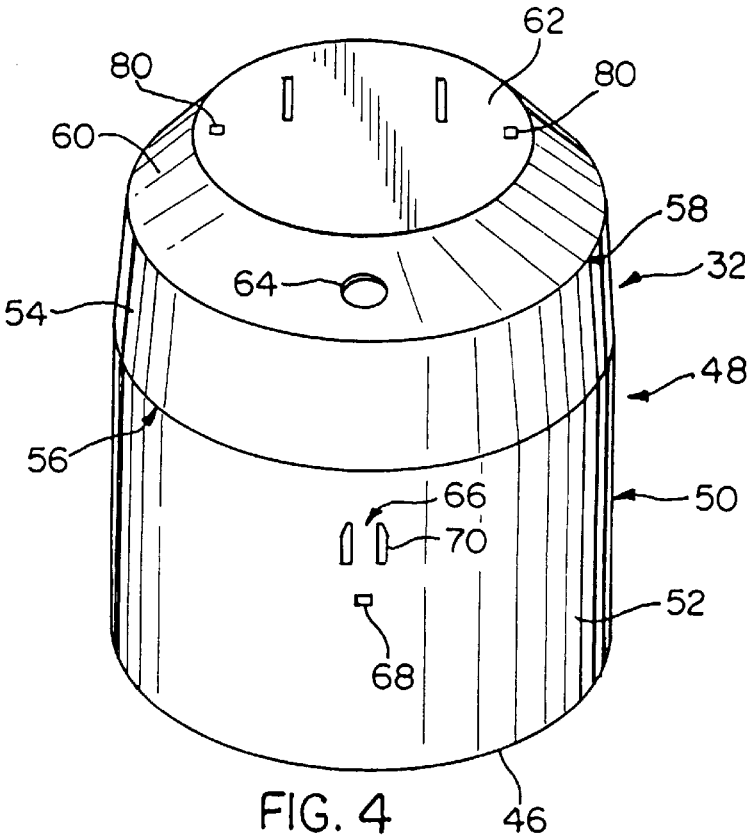
FIG. 4 is a perspective view of the universal lamp housing.

Referring now to FIGS. 3 through 12 and particularly to FIG. 3, a recessed downlight fixture configured according to the invention is seen at 30 to comprise a lamp housing 32 (often referred to in the industry as a "can") mounted by a wire pan 34. The wire pan 34 also mounts junction box 36 and a set of rails 38. The junction box 36 mounts a second set of rails 40, the sets of rails 38 and 40 acting to mount the fixture 30 between joists (not shown) of a ceiling (not shown). The wire pan 34, junction box 36 and sets of rails 38, 40 are disclosed and described in detail in copending United States patent application Ser. No. 08/610,431, now U.S. Pat. No. 5,690,423, entitled Wire Frame Pan Assembly for Mounting Recessed Lighting in Ceilings and the Like and assigned to the present assignee. It is to be understood that the lamp housing 32 can be supported by "pans" of varying type including the thermoplastic pan disclosed and described in detail in copending United States patent application Ser. No. 08/642,313, now U.S. Pat. No. 5,662,414, entitled Thermoplastic Pan Assembly for Mounting Recessed Lighting Fixtures in Ceilings and the Like, and assigned to the present assignee. The disclosures of these patent applications are incorporated hereinto by reference. It is further to be understood that other pan structures can be used as the primary support element of the fixture 30 without departing from the scope and intent of the invention. Conventional metal pans including painted metal pans as are common in the art can be conveniently used as the primary support element for the fixture 30. Such pans as well as the pans disclosed in the aforesaid United States patents typically support junction box structure through which electrical conductors feed into a lamp housing such as the housing 32 to power lamping (not shown in FIG. 3), the conductors typically being carried by an armored conduit 42 or similar structure.

The fixture 30 as shown is intended for mounting between joists (not shown) of a ceiling or to a T-bar sub-ceiling as is known in the art, the fixture being dimensioned as shown to fit a 2×8 joist construction. Using the structure seen in FIG. 3, it is necessary to provide only one rough-in in stock in order to meet requirements for both I.C. and non-I.C. installations. The housing 32 of FIG. 3 inter alia is provided with a pair of diametrically opposite elongated slots 44 spaced from lower perimetric edge 46 of the housing 32, the slots 44 having longitudinal axes which extend in the same direction and parallel to the longitudinal axis of the substantially cylindrical housing 32. The slots 44 allow adjustment of the housing 32 relative to the wire pan 34 and a ceiling hole (not shown) above which the housing 32 is mounted so that ceiling thicknesses of up to three inches can be accommodated. With a housing height of 7.5 inches, a slot length of 2.31 inches and a spacing of each of the slots 44 a distance of 0.59 inch from the edge 46, a ceiling thickness of three inches or less can be accommodated. Greater ceiling thicknesses can be accommodated with slots of greater length though such ceiling thicknesses are not usual.

Lamping, trim and other structure which is disposed substantially internally of the lamp housing 32 cannot be seen in FIG. 3 but will be shown in certain of the drawing figures which are to be discussed hereinafter.

Referring now to FIGS. 4, 5 and 8 through 11, a preferred embodiment of the lamp housing 32 is seen in detail. The lamp housing 32 takes the form of a deep-drawn, one-piece can 50 which forms the body of the housing 32. The can 50 is formed with a lower cylindrical body portion 52 which typically has a height accounting for about sixty percent of the height of the can itself. The circular break at which the lower body portion 52 tapers slightly to form frusto-conical body portion 54 is referred to as step 56. The step 56 facilitates stacking of the cans 50 during manufacture and storage. While provision of the step 56 is preferred, it is to be understood that the can 50 can be formed without the step 56. It is to be noted with reference to FIG. 8 that the outer diameter of the body portion 52 in one practical application is 6.75 inches, the outer diameter of the body portion 54 at its termination at 58 being preferably taken to be 6.37 inches. The body portion 54 tapers at 58 to form upper frusto-conical body portion 60, the taper of the body portion 60 being at an angle of approximately 45° from a line extending parallel to the cylindrical surfaces of the body portion 52. At 58, the taper of the body portion 54 has an inside radius of 0.093 inch. At 61, the taper of the body portion 60 to form the top 62 has an outside radius of 0.187 inch. The normal distance from the top 62 to the center point of the aperture 64 is 0.56 inch. The can 50 is completed by top 62 which is circular in conformation.

Figure 7:
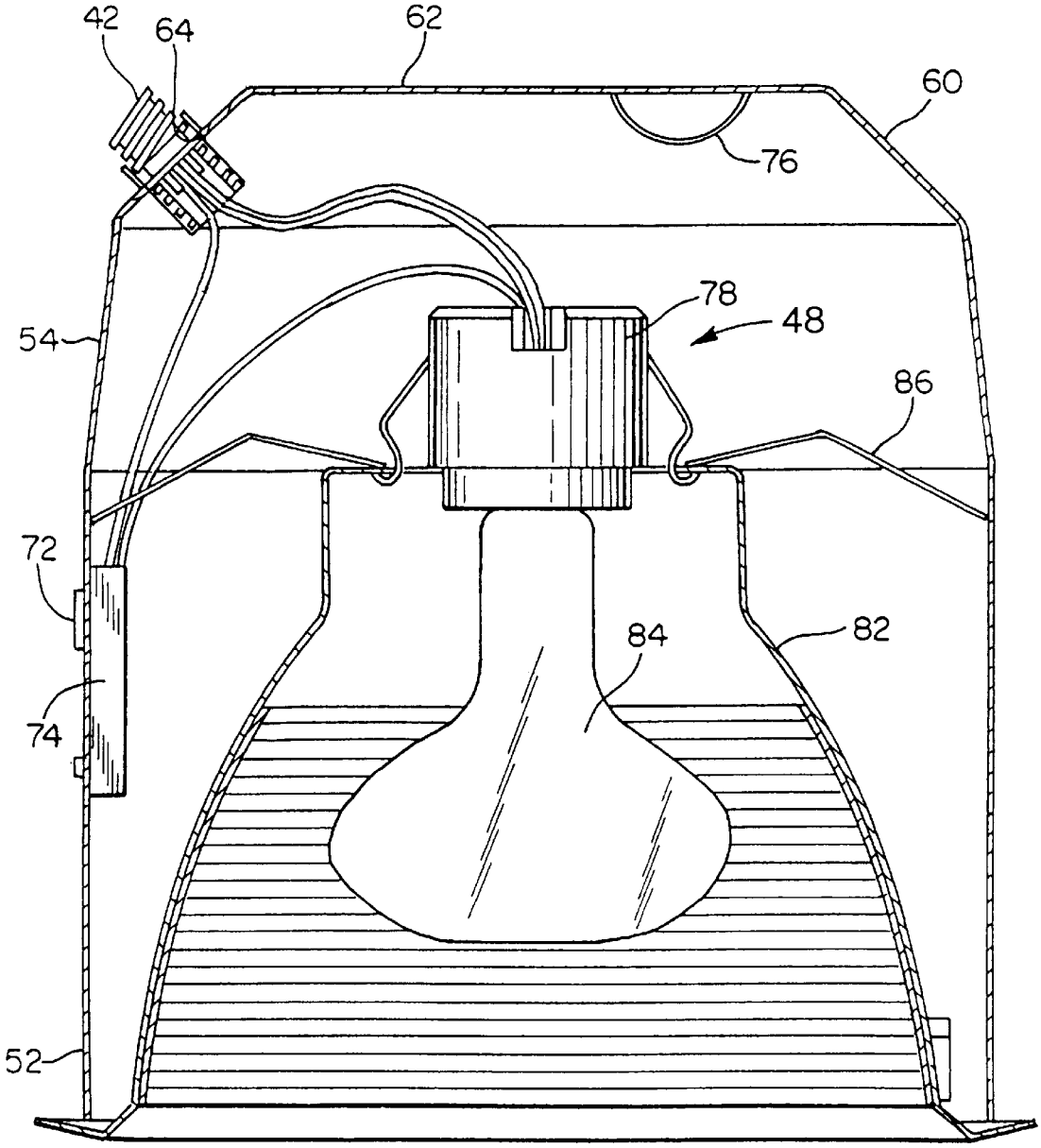
FIG. 7 is a side elevational view in partial section of the lamp housing fitted with certain remaining portions of a downlight assembly.

A convenient height for the can 50 is 7.5 inches with an outside diameter of 6.75 inches, these dimensions allowing ready fit of the can 50 and lamp housing assembly 48 of FIG. 7 forming a portion of the fixture 30 within the confines of typical 2×8 construction. Insulation contact is facilitated in an I.C. environment by formation of the can 50 without rivets, seams or sharp edges, hot spots therefore being prevented which could present fire hazards when in contact with insulation in an I.C. installation.

An aperture 64 is formed in the upper frusto-conical body portion 60for receipt of one end of the conduit 42, the location of the aperture 64 being spaced essentially half way between the slots 44 when viewed from above. A pattern 66 of apertures is formed in the outer wall of the cylindrical body portion 52 in alignment with the aperture 64 and slightly above the mid-point of the height of the can 50. The pattern 66 consists of a lower rectangular aperture 68 and spaced upper apertures 70 which are identical in size and shape to each other. The apertures 70 are substantially rectangular with an outer corner being "cut-away". The lower edge of the aperture 68 can be conveniently spaced according to the embodiment shown at a spacing of 2.52 inches from the edge 46 of the can 50. The pattern 66 receives snap elements 72 of a thermal protector 74 to mount the thermal protector at a preferred location within the interior of the can 50. The thermal protector 74 is a thermal sensor such as is manufacturing by Texas Instruments with temperature designations as will be discussed hereinafter. The thermal protector 74 functions to shut off power to lamping within the housing 32 in the event that surface temperatures exceed 90° C. in any I.C. environment or 150° C. in a non-I.C. environment.

Figure 8:
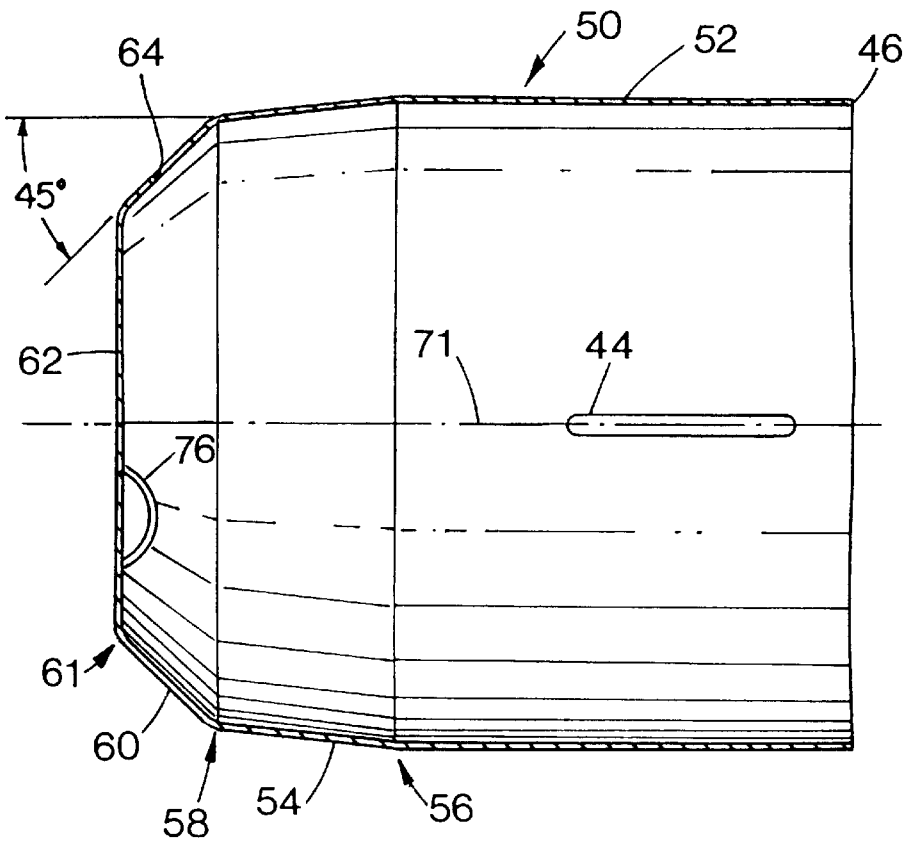
FIG. 8 is a side elevational view in section of the lamp housing.
Figure 9:
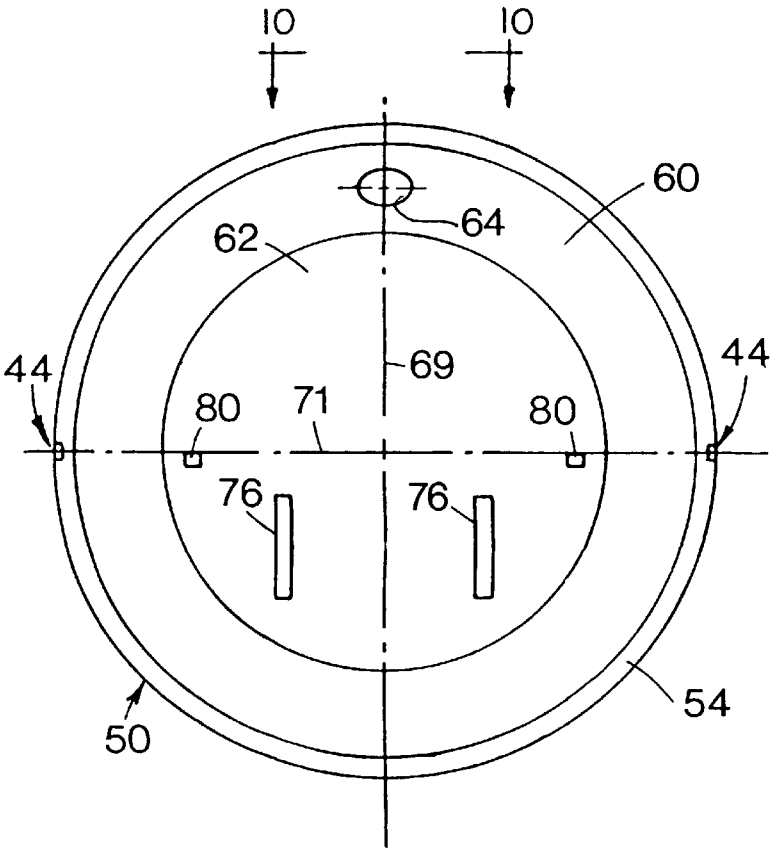
FIG. 9 is a plan view of the lamp housing.
Figure 10:
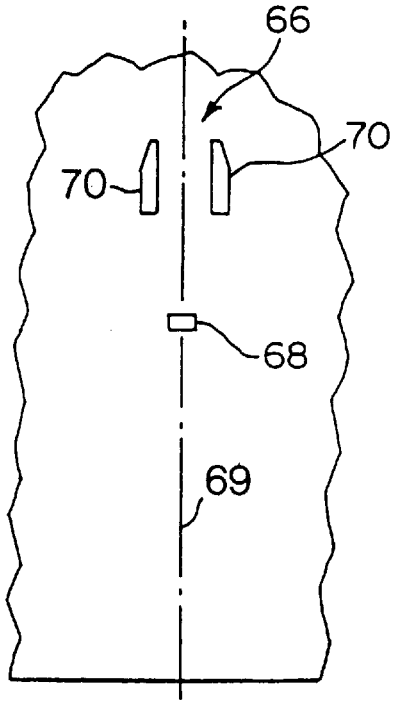
FIG. 10 is a detailed view of a thermal protector aperture mounting arrangement formed in a wall of the lamp housing at a location as shown by lines 10—10 of FIG. 9.
Figure 11:
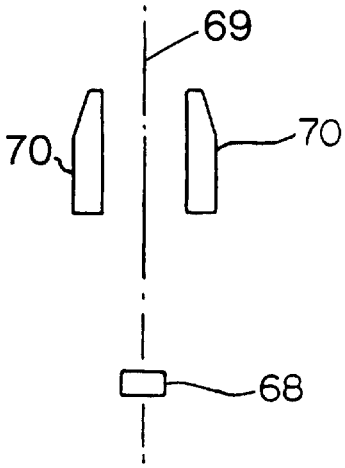
FIG. 11 is a detailed view of the aperture mounting arrangement of FIG. 10.

With reference to FIG. 11, dimensions of the apertures 68 and 70 and relationships therebetween can be understood in relation to the can 50 of FIGS. 8 and 9. Inner facing edges of the upper apertures 70 are spaced 0.365 inch apart, the width of each aperture 70 being typically 0.130 inch and the height of each aperture 70 typically being 0.531 inch. The height of the "cutaway" portion of each of the apertures 70 is typically 0.218 inch. The width of the remaining portion of the width-wise edge of each of the apertures 70 which is not cut-away is typically 0.062 inch. The distance normal to lines in which the uppermost edges of the apertures 70 and the lowermost edge of the aperture 68 lie is 1.335 inch. The length of the aperture 68 is 0.200 inch and the width is 0.100 inch. A centerline 69 which extends through the center of the aperture 64 lies slightly closer to the aperture 70 to the right of FIG. 11, the normal distance from the centerline 69 and the closest length-wise edge of said aperture 70 being 0.187 inch. The centerline 69 extends through the aperture 68 medially thereof with a spacing from each width-wise edge of the aperture 68 being 0.100 inch, the centerline 68 thereby bisecting the aperture 68.

The can 50 is further provided with a pair of stirrups 76 punched from the top 62, the stirrups 76 acting to mount porcelain socket 78 during shipping in order to prevent breakage of the socket 78. Further, this location of the socket 78 prior to actual use prevents the socket from being filled with paint or ceiling texture material or the like during installation. The stirrups 76 are mounted in spaced relation to each other within the confines of that half of the top 66 opposite the location of the aperture 64. Spaced square apertures 80 are located essentially along a diameter 71 of the top 62, this diameter 71 being aligned with the slots 44 when said diameter 71 is geometrically caused to extend along the side of the can 50, the apertures 80 being provided in the event that coil springs (not shown) are to be used to mount finishing trim 82 (shown in FIG. 7 in an operational arrangement). In preferred embodiments, the finishing trim 82 is mounted as will be described in detail hereinafter relative to FIG. 7.

Referring to FIG. 9, it is to be understood that the centerline 69 essentially extends through the center point of the top 62 and has a normal spacing of 1.87 inches from inner edges of the apertures 80 located to the right in FIG. 9 and a normal spacing of 0.93 inch from innermost edges of the stirrups 76 located to the right in FIG. 9. The innermost edges of the stirrups 76 are spaced apart a distance of 1.87 inches. The innermost edges of the apertures 80 are spaced apart a distance of 3.61 inches. The width of the forming apertures from which the stirrups 76 are formed and extend is typically 0.18 inch. The distance from a line bisecting the apertures from which the stirrups 76 are formed and extend and the centerline 71 (and parallel to the centerline 71) is 1.0 inch.

The material from which the can 50 is formed is preferably aluminum or steel with alloys of same being appropriate given the exigencies of forming processes and required thermal characteristics. Since corrosion resistance is of importance, galvanized or plated steel is preferably used. Steel may also be painted. The thickness of the walls of the can 50 is typically 0.032 inch when aluminum is the selected material. When steel is selected, a thickness of 0.029 inch is typical for galvanized material and 0.026 inch for uncoated steel. Alternative steel materials are to be G60 equivalent. The top 62 can have a slightly greater thickness of approximately 0.035 inch as an example.

When using the wire pan 34 of FIG. 3, the can 50 can be formed of aluminum or galvanized steel in preferred embodiments. When formed of aluminum, the dimensions given relative to FIGS. 8 and 9 prove useful. When formed of galvanized steel the height of the uppermost edge of the slots 44 preferably is 4.0 inches instead of 4.62 inches. Similarly, the length of the slots 44 can be 2.25 inches instead of 2.31 inches. The distance of the lowermost edge of the slots 44 to the edge 46 can be 0.50 inch rather than 0.59 inch. The width of the slots 44 is taken to be 0.18 inch in the embodiment of FIGS. 8 and 9.

The can 50 can be formed of aluminum or an alternate material when used with the wire pan 34 or with either a thermoplastic pan as referred to above or with a painted steel pan as is common in the art. When using a painted steel pan, the can 50 can be formed of galvanized steel having a thickness of 0.029 inch.

The volume of the can 50 is nominally 245 cubic inches. The can 50 can be otherwise shaped, it being necessary to maintain a relationship between can volume and height which allows functioning of the can 50 and fixture per se as indicated herein. Dimensions must be selected which, with a lamp of appropriate wattage, will cause the thermal protector 74 to function as is described fully herein.

Referring now to FIG. 7,the lamp housing assembly 48 is best seen to comprise a lamp 84 mounted in fixed photometrically and thermally appropriate position by the socket 78 and positioning clip 86 which connect to the finishing trim 82. The structure thus shown acts to maintain the lamp 84 in an appropriate position to yield desirable light distribution characteristics as well as necessary thermal characteristics. The trim 82 is rated I.C. when the I.C./non-I.C. can 50 is to be used in an I.C. environment. The trim 82 is selected to be a non-I.C. trim when the I.C./non-I.C. can 50 is to be used in a non-I.C. environment. An I.C. rated trim can be utilized in a non-I.C. application with a lamp of the same wattage.

Figure 5:
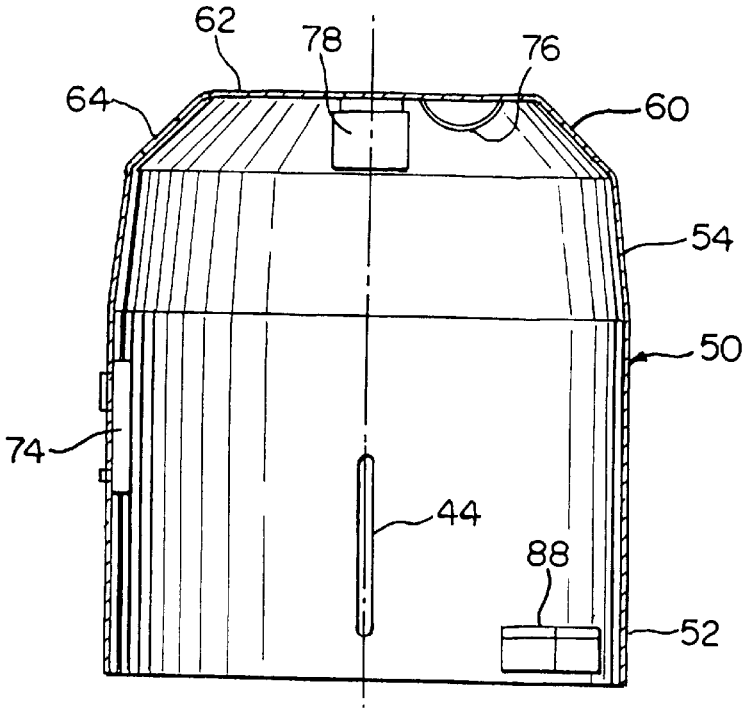
FIG. 5 is a side elevational view in section of the housing of FIG. 4.

As is best seen in FIGS. 5 and 7, the thermal protector 74 is mounted to an interior wall of the can 50 and particularly to an interior wall of the lower cylindrical body portion 52. The thermal protector 74 can be mounted to the exterior of the can 50 or at other locations of the interior walls of the can 50 as long as the location of the protector 74 allows functioning of the protector 74 in a manner suitable to the intent of the invention. The thermal protector 74 is shown in the drawings as being located in proximity to the aperture 64 which is itself located in a relatively close relationship to the J-box 36. The protector 74 can be located essentially below the aperture 64 to provide results of a very satisfactory degree. When given the various relationships which come into play in the formation of the can 50, that is, the relationships of can material, material thickness, can height, can volume, can surface area, size and location of openings in the can, etc., the protector 74 can be positioned at locations which result in a suitable functioning. The characteristics of the can 50 also couple with factors including lamp type and wattage, lamp shape, lamp position, reflector material and shape and further with the thermal rating of the protector 74 itself. Permitted variations of these relationships are determined by test.

The thermal protector 74 is preferably chosen to be that product of Texas Instruments, Inc., having designations of TI 7AM027A5; TI 7AM028A5 and TI 7AM029A5 with ratings of 100° C.; 105° C. and 110° C. respectively. The Texas Instrument product is placed in a casing and crimped to lead wires by the Leviton Corporation. A can 50 formed of aluminum and useful with either a steel pan or the thermoplastic pan as aforesaid is preferably used with TI 7AM029A5 and is positioned 2.5 inches from the lower edge 46 of the can 50. The protector so configured and located will "kick out" at a temperature of 110° C. ±5° C. The can 50 can be formed of steel with similar positioning and functioning of the protector 74. The can 50 formed of steel and dimensioned according to the alternative values mentioned above which differ from the dimensions shown in FIGS. 8 and 9 can be fitted with TI 7AM027A5 with "kick out" at 100° C. The protector 74 is set at a rating which allows functioning of the fixture as noted herein in both I.C. and non-I.C. installations without on-site modification or adjustment.

Figure 6:
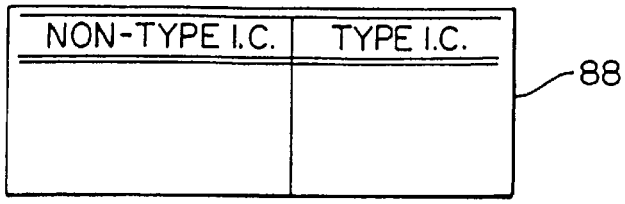
FIG. 6 is a detailed view of the I.C./non-I.C. marking.

As seen in FIGS. 5 and 6, a label 88 is provided for marking of the can 50 to indicate rating of the can 50 as both I.C. listed and non-I.C. listed. The can 50 and thus the fixture 30 is therefore rated I.C. and non-I.C. and can be utilized in both types of installations. Label 88 is best shown in FIG. 6. Although not shown, the label 88 designates the finishing trims which can be used in the I.C. environment and in the non-I.C. environment. Indication of the conditions in the I.C. environment and in the non-I.C. environment which causes cycling of the lamp 84 is also provided on the label 88.

The can 50 and indeed the fixture 30 are designed to satisfy those requirements necessary to produce the I.C./non-I.C. function. A first step in the design process is in the selection of the light source and particularly the wattage, shape and type or types as well as lamp position. Selection of material follows with wall thickness being determined as a function of heat transfer capability and necessary strength. Can size including can dimension, particularly volume, aperture, surface area and shape is determined by those dimensions capable of providing the heat loss capability which will prevent operation of the protector 74 within specified temperature ranges and cause protector operation above those ranges. Trim capable of function as I.C. only or I.C./non-I.C. when used in an I.C. environment and as non-I.C. only or I.C./non-I.C. when used in a non-I.C. environment is then selected. The location of the thermal protector 74 can be varied on inner or outer wall surfaces of the can 50 to provide the desired operation.

Figure 12:
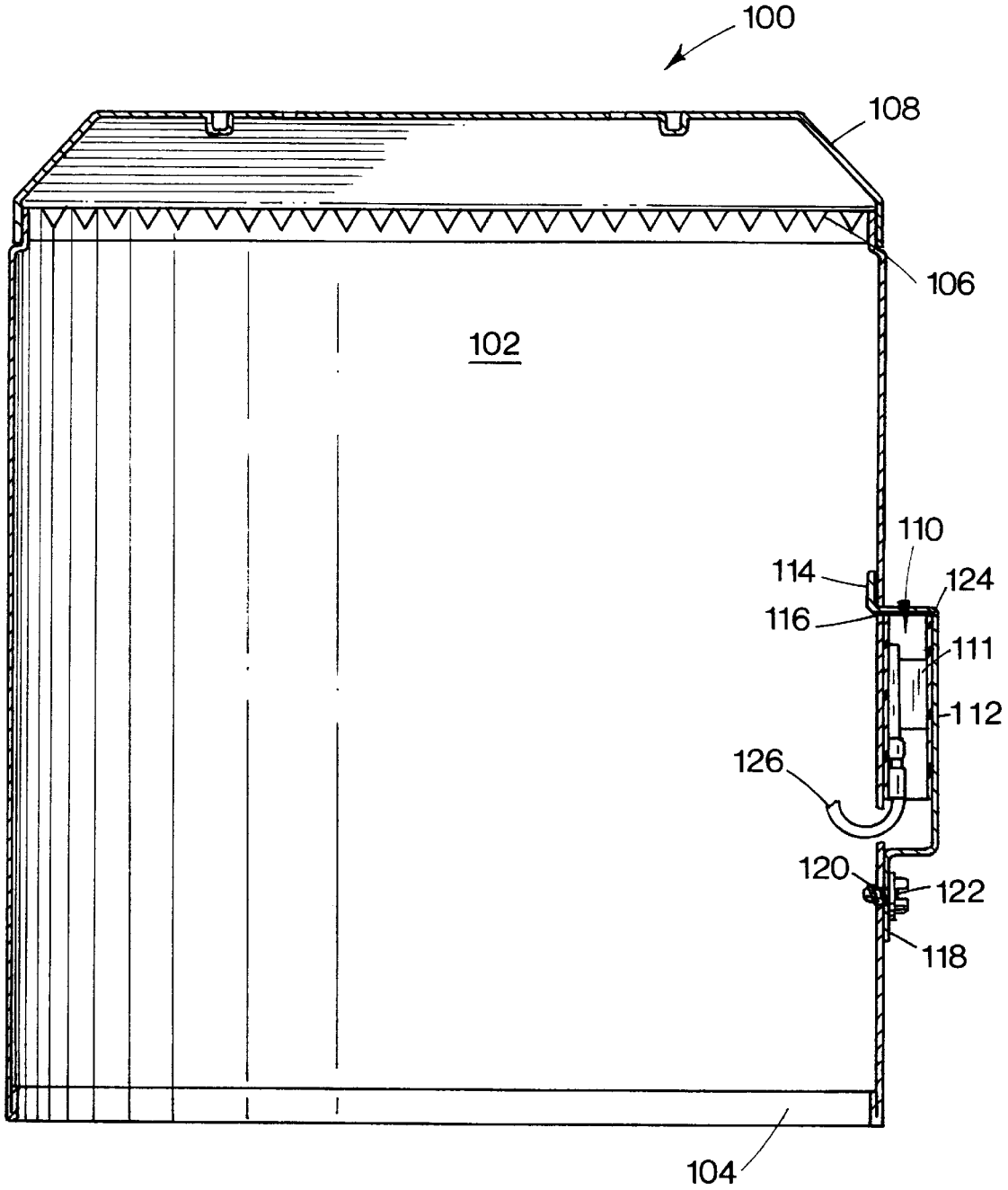
FIG. 12 is a side elevational view in partial section of a two-piece housing having a thermal protector disposed externally of the housing and capable of measuring temperature externally of the housing.

Referring now to FIG. 12, a can 100 is illustrated as comprising a two-piece can which ban be devised for use according to the invention to function substantially in the manner of the can 50 described hereinabove. While the one-piece can 50 is preferred, the two-piece can 100 of FIG. 12 is useful within the same environments as described relative to the can 50. The can 100 is formed of a cylindrical base 102 having a hemmed edge 104 at an open end of the can 100 and a fluted edge 106 at the enclosed end of the base 102. Using standard manufacturing techniques, the fluted edge 106 of the base 102 can be joined to top portion 108 which effectively takes a frusto-conical form. The structure of FIG. 12 primarily illustrates the disposition of a thermal protector 110 on an outside surface of the can 100, the protector 110 being housed within housing 112 which can be formed of a suitable polymeric material or which can be formed of metal or the like. The housing 112 includes an upper flange 114 which can extend into an opening 116 formed in the side of the base 102, a lower plate 118 having an aperture 120 formed therein receiving a screw 122 which completes attachment of the housing 112 to the can 100. Other conventional techniques, such as tab wiping, pinching, riveting, etc., can be used.

The thermal protector 110 is conveniently wrapped in a mylar film 124 as is conventional and effectively mounts to the outer wall portion of the base 102 which lies within the confines of the housing 112. Wiring 126 extends from the thermal protector 110 into the interior of the can 100 to a lamp socket (not shown) or the like for control of lamping (not shown). The thermal protector 110 is positioned so that measurement of external surface temperatures of the can 100 can be taken in order to control operation of lamping as has been described herein. In this regard, sensing head 111 of the protector 110 faces outwardly from the can 100 in order to sense temperature externally of the can 100.

Figure 13:
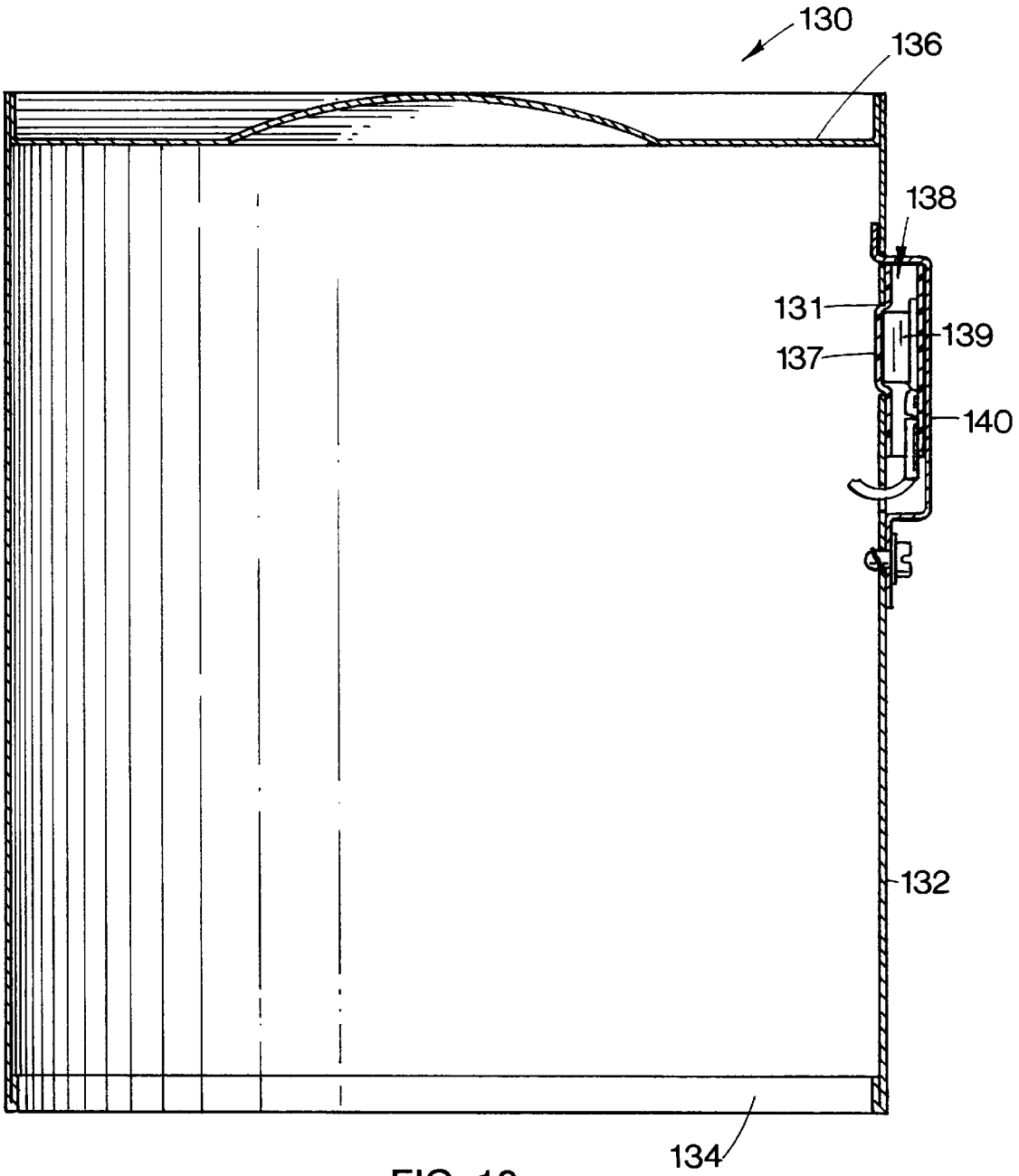
FIG. 13 is a side elevational view in partial section of another embodiment of a two-piece housing having a thermal protector disposed externally of the housing and capable of measuring temperature internally of the housing.

Referring now to FIG. 13, another lamp housing referred to as can 130 is seen to comprise two pieces including a cylindrical base 132 having a hemmed edge 134. The cylindrical base 132 can be formed according to a variety of manufacturing techniques including roll forming wherein material from a straight coil is punched and hemmed and then joined into a cylinder by offsetting of lip edges (not shown) followed by rolling. Although not preferred, rivets or the like can be used to hold the base 132 in the shape of a cylinder. Alternatively, toggle locking can be employed although riveting usually produces a better lineup with greater ease of manufacture. A domed top element 136 can be attached in a conventional manner to form a closed end of the can 130 as is shown in FIG. 13. FIG. 13 further illustrates the disposition of a thermal protector 138 disposed within a housing 140 exteriorly of the can 130 with the thermal protector 138 measuring temperatures internally of the can 130. Mounting of the housing 140 and of the thermal protector 138 to the can 130 can be accomplished in a manner similar to the mounting of corresponding elements described previously relative to FIG. 12. Sensing head 139 of the protector 138 faces inwardly of the can 130 and effectively communicates with the interior of the can 130 through opening 131 formed in the wall of the can. Mylar film 137 wraps the protector 138 and that portion of the film 137 surmounting the head 139 is press fit along with the head 139 into the opening 131.

Figure 14:
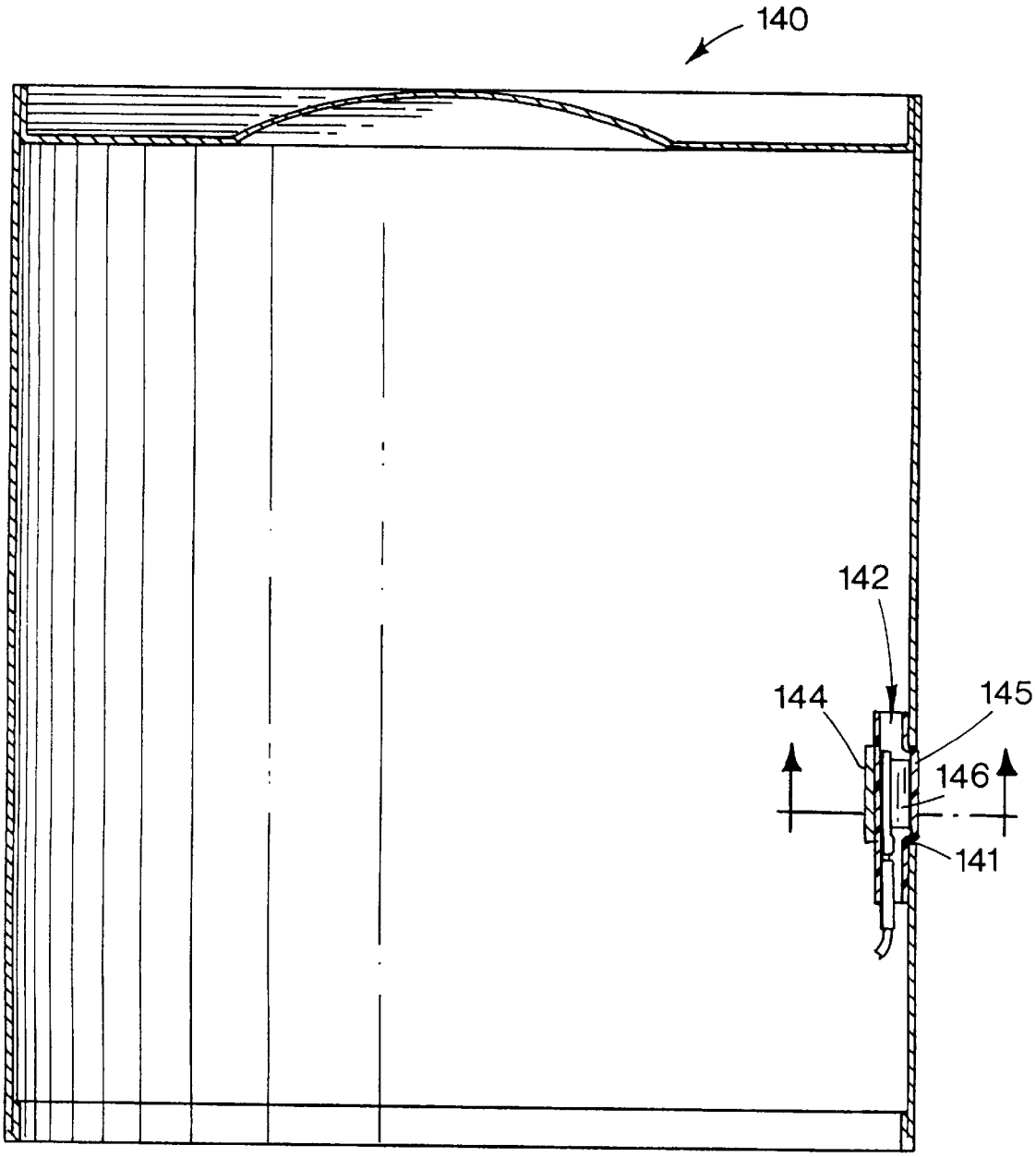
FIG. 14 is a side elevational view in partial section of a further embodiment of the invention and having a thermal protector disposed internally of the housing and capable of measuring temperature externally of the housing; and, FIG. 15 is a sectional view taken along lines 15—15 of FIG. 14.

FIG. 14 is essentially identical to FIG. 13 with the exception that a thermal protector 142 is disposed interiorly of can 140 and is positioned to measure temperatures externally of the can 140 through opening 141 formed in the can 140. Details such as mounting of the thermal protector 142 and location thereof also differ and can vary without departing from the scope of the invention.

Figure 15:
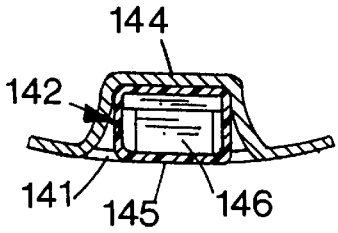

FIG. 15 illustrates a particular mounting wherein a stirrup 144 has been punched from the wall of the can such as to form all or a part of the opening 141, the stirrup then receiving the thermal portector 142 wrapped in Mylar film 145 to mount said protector. Sensing head 146 and the film 145 surmounting said head are press fit into the opening 141 to measure temperature externally of the can 140.

It is to be understood that the cans 100, 130 and 140 of FIGS. 12 through 14 can be configured with structural features similar or substantially identical to those structural features described hereinabove relative to the can 50. It is further to be understood that the can 50 can be configured to function as desired with location of a thermal protector on exterior surfaces thereof either to measure external temperatures or temperatures internal of the can. Similar can sizes including volume, aperture, surface area, height and the like can be employed when forming any of the cans herein described. When measuring temperatures exteriorly of the cans, temperature can be measured either on the exterior surface of said cans or near the exterior surface of said cans such as within the "test box" of the can and/or fixture which is defined as a volume about the can and/or fixture within which temperatures can be measured which are useful in controlling the operation of said fixtures. It is also to be understood that cans according to the invention can be formed of multiple pieces in configurations too numerous to detail herein.

The fixture 30 of the invention can be used in both new construction and in retrofit construction. Both residential and commercial construction can utilize the fixtures of the invention when fitted with the I.C. and non-I.C. cans of the invention. It is also to be understood that the invention can take forms other than as expressly described herein, the cans 50, 100, 130 and 140 especially being capable of taking other forms such as other shapes and being capable of formation as multiple piece structures, the scope of the invention being defmed by the claims hereinafter recited.

What is claimed is:

1. A downlight fixture having a pan support, a junction box and a can mounting a first lamp having a preferred wattage for an insulation contact installation, the can mounting a second lamp having a second preferred wattage for a non-insulation contact installation, the fixture being usable in both insulation contact installations and non-insulation contact installations when respectively employing the first and second lamps of first and second preferred wattages, means carried by the can for controlling operation of the fixture in either an insulation contact installation or a non-insulation contact installation at said respective preferred wattages, said means comprising a thermal protection device mounted on a surface of a can for sensing the existence of a first temperature when the fixture is used in an insulation contact installation and a second temperature when the fixture is used in a non-insulation contact installation, the can being formed of a material and having a volume causing surfaces of the can to maintain a temperature not to exceed the first temperature in an insulation contact installation and not to exceed the second temperature in a non-insulation contact installation when in use with the respective lamps of the respective preferred wattages.

2. The fixture of claim 1 wherein the first temperature is equal to or less than 90° C. and wherein the second temperature is equal to or less than 150° C.

3. The fixture of claim 1 wherein the controlling means is disposed interiorly of the can.

4. The fixture of claim 3 wherein at least the first temperature is sensed at a location interiorly of the can.

5. The fixture of claim 4 wherein the second temperature is sensed at a location interiorly of the can.

6. The fixture of claim 1 wherein at least the first temperature is sensed at a location interiorly of the can.

7. The fixture of claim 6 wherein the second temperature is sensed at a location interiorly of the can.

8. The fixture of claim 1 wherein the controlling means is disposed exteriorly of the can.

9. The fixture of claim 8 wherein at least the first temperature is sensed at a location exteriorly of the can.

10. The fixture of claim 9 wherein a second temperature is sensed at a location exteriorly of the can.

11. The fixture of claim 1 wherein at least the first temperature is sensed at a location exteriorly of the can.

12. The fixture of claim 11 wherein the second temperature is sensed at a location exteriorly of the can.

13. The fixture of claim 1 wherein the can comprises a lower cylindrical body portion, a first frusto-conical body portion terminating the cylindrical body portion medially of the can, a second frusto-conical body portion terminating the first frusto-conical body portion and a top terminating the second frusto-conical body portion.

14. The fixture of claim 1 wherein the can is formed of at least two pieces.

15. The fixture of claim 1 wherein the thermal protection means mounted to an interior wall of the can at a location at which the thermal protection means indicates the existence of a temperature exceeding 90° C. when the fixture is used in an insulation contact installation and 150° C. when the fixture is used in a non-insulation contact installation.

16. The fixture of claim 1 wherein the lamp is a 75 W BR lamp when the fixture is used in an insulation contact installation.

17. The fixture of claim 1 wherein the lamp is a 150 W BR lamp when the fixture is used in a non-insulation contact installation.

18. In a downlight fixture having a can mounting a first lamp having a wattage of a value less than or equal to a first preferred wattage for use in an insulation contact installation, the can mounting a second lamp having a wattage of a value less than or equal to a second preferred wattage for use in a non-insulation contact installation, the fixture being usable in both insulation contact installations and non-insulation contact installations when respectively employing the first and second lamps of said first and second preferred wattages, means carried by the can for controlling the operation of the fixture in an insulation contact installation to prevent operation of the fixture in an insulation contact installation at a temperature exceeding 90° C. and to prevent operation of the fixture in a non-insulation contact installation at a temperature exceeding 150° C.

19. In the fixture of claim 18 wherein said controlling means comprise a thermal protection means mounted on a surface of the can and functioning through sensing of the temperature of a surface of the can.

20. In the fixture of claim 19 wherein the thermal protection means is mounted to an inner wall surface of the can.

21. In the fixture of claim 20 wherein the thermal protection means functions through sensing of the temperature of an inner surface of the can.

22. In the fixture of claim 19 wherein the thermal protection means is mounted to an exterior wall surface of the can.

23. In the fixture of claim 22 wherein the thermal protection means functions through sensing of the temperature of an exterior wall surface of the can.

24. In the fixture of claim 22 wherein the thermal protection means functions through sensing of the temperature of an interior wall surface of the can.

25. In the fixture of claim 20 wherein the thermal protection means functions through sensing of the temperature of an exterior wall surface of the can.

26. A downlight fixture having a pan support, a junction box and a can mounting a first lamp having a first preferred wattage for an insulation contact installation, the can mounting a second lamp having a second preferred wattage for a non-insulation contact installation, the fixture being usable in both insulation contact installations and non-insulation contact installations when respectively employing the first and second lamps of said first and second preferred wattages, means carried by the can for operating the fixture in either an insulation contact installation or a non-insulation contact installation at said respective preferred wattages, said means comprising a thermal protection device mounted on an exterior surface of the can for sensing the existence of a first temperature when the fixture is used in an insulation contact installation and a second temperature when the fixture is used in a non-insulation contact installation, the can being formed of a material and having a volume causing surfaces of the can to maintain a temperature not to exceed the first temperature in an insulation contact installation and not to exceed the second temperature in a non-insulation contact installation when in use with the respective lamps of the respective preferred wattages.

27. The fixture of claim 26 wherein the thermal protection device senses temperature externally of the can.

28. The fixture of claim 26 wherein the thermal protection device senses temperature intgernally of the can.

29. The fixture of claim 26 wherein the can is formed of more than one piece of material.

30. A downlight fixture having a pan support, a junction box and a can mounting a first lamp having a first preferred wattage for an insulation contact installation, the can mounting a second lamp having a second preferred wattage for a non-insulation contact installation, the fixture being usable in both insulation contact installations and non-insulation contact installations when respectively employing the first and second lamps of said first and second preferred wattages, means carried by the can for operating the fixture in either an insulation contact installation or a non-insulation contact installation at said respective preferred wattages, said means comprising a thermal protection device mounted on an interior surface of the can for sensing the existence of a first temperature when the fixture is used in an insulation contact installation and a second temperature when the fixture is used in a non-insulation contact installation, the can being formed of a material and having a volume causing surfaces of the can to maintain a temperature not to exceed the first temperature in an insulation contact installation and not to exceed the second temperature in a non-insulation contact installation when in use with the respective lamps of the respective preferred wattages.

31. The fixture of claim 30 wherein the thermal protection device senses temperature externally of the can.

32. The fixture of claim 30 wherein the thermal protection device senses temperature internally of the can.

33. The fixture of claim 30 wherein the can is formed of more than one piece of material.

34. In a downlight fixture having a can mounting a first lamp having a wattage of a value less than or equal to a first preferred wattage for use in an insulation contact installation, the can mounting a second lamp having a wattage of a value less than or equal to a second preferred wattage for use in a non-insulation contact installation, the fixture being usable in both insulation contact installations and non-insulation contact installations when respectively employing the first and second lamps of said first and second preferred wattages, means carried by the can for operating the fixture in an insulation contact installation at or below the first preferred wattage of the first lamp and in a non-insulation contact installation at or below the second preferred wattage of the second lamp, the operating means being disposed at least partially exteriorly of the can.

35. The downlight fixture of claim 34 wherein said means comprise thermal protection means mounted on an exterior surface of the can for preventing the temperature of said can from exceeding a predetermine first temperature on use of the fixture in an insulation contact installation and from exceeding a predetermined second temperature on use of the fixture in a non-insulation contact installation.

36. The downlight fixture of claim 35 wherein the thermal protection means functions through sensing of the temperature of a surface of the can.

37. The downlight fixture of claim 35 wherein the first temperature is approximately 90° C. and the second temperature is approximately 150° C.

38. The downlight fixture of claim 34 wherein the thermal protection means functions through sensing of the temperature interiorly of the can.

39. The downlight fixture of claim 38 wherein the thermal protection means functions through sensing of the temperature of an interior wall surface of the can.

40. The downlight of claim 38 wherein the first temperature is approximately 90° C. and the second temperature is approximately 150° C.

41. The downlight fixture of claim 34 wherein the can is formed of a material and has a volume which causes the can to maintain a first temperature not to exceed a predetermined first temperature in an insulation contact installation and a second temperature not to exceed a predetermined second temperature in a non-insulation contact installation when in use with said lamps of said specified preferred wattages.

42. The downlight fixture of claim 41 wherein the first temperature is approximately 90° C. and the second temperature is approximately 150° C.

43. The downlight fixture of claim 35 wherein the thermal protection means is mounted to an exterior wall of the can at a location at which the thermal protection means prevents the temperature of the can from exceeding a predetermined first temperature on use of the fixture in an insulation contact installation and from exceeding a predetermined second temperature on use of the fixture in a non-insulation contact installation.

44. The downlight fixture of claim 43 wherein the first temperature is approximately 90° C and the second temperature is approximately 150° C.

45. A method for controlling the operation of lamping mounted by a fixture having a support and a lamp housing mounted by the support and mounting a first lamp for operation having a first preferred wattage for an insulation contact installation, the lamp housing mounting a second lamp having a second preferred wattage for a non-insulation contact installation, the fixture being usable in both insulation contact installations and non-insulation contact installations when respectively employing the first and second lamps, the fixture having a thermal protection device carried thereby, comprising the steps of:

operating the lamps respectively in insulation contact and non-insulation contact installations;

sensing the existence by means of the thermal protection device of a first temperature when the fixture is used in an insulation contact installation and a second temperature when the fixture is used in a non-insulation contact installation; and, discontinuing operating power to the lamps respectively in the event the sensed first and second temperatures are exceeded.

* * * * *